US007395865B2

(12) United States Patent
Bender

(10) Patent No.: US 7,395,865 B2
(45) Date of Patent: Jul. 8, 2008

(54) GAS LIFT PLUNGER ARRANGEMENT

(75) Inventor: Robert E. Bender, Morrison, CO (US)

(73) Assignee: Well Master Corp., Lakewood, CO (US)

( * ) Notice: Subject to any disclaimer, the term of this patent is extended or adjusted under 35 U.S.C. 154(b) by 220 days.

(21) Appl. No.: 11/350,367

(22) Filed: Feb. 8, 2006

(65) Prior Publication Data

US 2006/0185853 A1 Aug. 24, 2006

Related U.S. Application Data

(60) Provisional application No. 60/593,914, filed on Feb. 24, 2005.

(51) Int. Cl.
*E21B 43/12* (2006.01)
*E21B 33/08* (2006.01)

(52) U.S. Cl. ..... 166/311; 166/68; 166/105; 166/112; 166/177.3

(58) Field of Classification Search ..... None
See application file for complete search history.

(56) References Cited

U.S. PATENT DOCUMENTS 4,410,300 A * 10/1983 Yerian ..... 417/56
6,725,916 B2 * 4/2004 Gray et al. ..... 166/68.5

* cited by examiner

*Primary Examiner*—Zakiya W Bates
(74) *Attorney, Agent, or Firm*—Don Halgren

(57) ABSTRACT

A plunger in a plunger lift system in an oil and gas well includes shaped grooves spaced along the plunger body, angled fins or below the grooves, an elongated interior cavity open at the bottom, and passages connecting the interior cavity to the grooves. The shape, sizing and spacing of the grooves improves plunger seal and decreases liquid loss during plunger lift. The flutes or fins spin the plunger to clean the tubing string and prevent the plunger from becoming stuck in the lubricator. The interior cavity lightens the plunger and, in combination with the passages, improves the seal created by the shaped grooves. A method of controlling fluid flow in a tubing string in the plunger lift system includes the elongated plunger controllably traveling vertically therethrough, including the steps of: arranging an array of side holes through a side wall of the elongated plunger, wherein the side holes create turbulence in gas within the tubing string; and rotating the elongated plunger about a longitudinal axis thereof, as the plunger travels through the tubing string in the plunger lift system.

17 Claims, 2 Drawing Sheets

GAS LIFT PLUNGER ARRANGEMENT

BACKGROUND OF THE INVENTION

1. Field of the Invention

This present invention relates to plunger lift systems for oil and gas wells, and more particularly to a gas lift plunger with an improved gas seal, and is based upon Provisional patent application Ser. No. 60/593,914, filed 24 Feb. 2005, and is incorporated herein by reference in its entirety.

2. Background Art

Plunger lift systems are artificial lift systems for oil and gas wells. U.S. Pat. No. 6,200,103 to Bender, incorporated herein by reference, discloses a gas lift plunger having a cylindrical elongated plunger body. The plunger body has a plurality of spaced, shaped circumferential grooves. The grooves are shaped to increase gas turbulence, and thereby improve plunger lift and reduce the flow of liquid around the plunger.

BRIEF SUMMARY OF THE INVENTION

A plunger for an oil or gas well has a cylindrical elongated plunger body with a top portion, an intermediate portion and a lower portion. The intermediate portion includes a plurality of longitudinally spaced, shaped circumferential grooves defined by recessed surfaces interspersed between sections of the peripheral surface of the plunger body. The plunger body has a cylindrical, interior cavity extending upwardly from the bottom with the interior cavity being open at the bottom and closed at the top. Vertically spaced sets of generally radially extending, circumferentially spaced passages extend from the interior cavity to the grooves. A plurality of circumferentially spaced, angled flutes or fins extend outwardly from the lower portion of the plunger body. The depth of the grooves and the size of the passages decreases from the bottom end to the top end of the plunger body.

More specifically, the invention comprises a plunger arrangement for moving up and down in a tubing string in a plunger lift system for an oil and gas well, the plunger having a gas seal arrangement comprising: an elongated plunger body having an upper end and a lower end, the plunger having a longitudinal axis, with a plurality of circumferentially grooves spaced longitudinally apart on an outer surface of the plunger body. A longitudinal bore is arranged within the plunger, extending from an opening in the lower end of the plunger, and an arrangement of fluid side-holes or passageways extend from the bore to the outer surface of the plunger body to permit gas flow therethrough to direct a turbulent flow of fluid about the plunger. In one embodiment, at least one of the passageways extends radially outwardly in the plunger body from said bore. In another preferred embodiment, at least one of the side holes or passageways extends at an acute angle with respect to the longitudinal axis of the plunger body from the bore. In another preferred embodiment, a plurality of fins may be arranged on the lower end of the body of the plunger to effect a rotational motion in the plunger as the plunger travels through the tubing string. The fins may be in a spiral array on the lower end of the plunger. The fins preferably have a tube wall-cleaning sharp edge for cleaning the inside of the tubing string as the plunger travels rotationally therethrough.

The invention also includes a method of controlling fluid flow in a tubing string in a plunger lift system of an oil and gas well wherein an elongated plunger controllably travels vertically therethrough, the method comprising one or more of the following steps: arranging an array of fins on a lower end of the elongated plunger, wherein the fins create turbulence in gas within the tubing string; and rotating the elongated plunger about a longitudinal axis thereof, as the plunger travels through the tubing string in the plunger lift system. The method may include: arranging an elongated bore in the plunger from the lower end thereof; and drilling a plurality of side holes into the bore through the plunger. The side holes in one embodiment may be arranged radially with respect to the longitudinal axis of the bore. The side holes may also be arranged at an acute angle with respect to the longitudinal axis of the bore. The method may also include one or more of the following steps: spinning the plunger about its longitudinal axis so as to generate turbulence in gas surrounding the plunger as the plunger travels through the tubing string in an oil and gas well lift system; ejecting gas through the side holes in the plunger to maximize turbulence of fluid surrounding the plunger as it travels in the tubing string in the oil and gas well lift system.

The invention may also include a method of controlling fluid flow in a tubing string in a plunger lift system of an oil and gas well wherein an elongated plunger controllably travels vertically therethrough, comprising one or more of the steps of: arranging an array of side holes through a side wall of the elongated plunger, wherein the side holes create turbulence in gas within the tubing string; and rotating the elongated plunger about a longitudinal axis thereof, as the plunger travels through the tubing string in the oil and gas well plunger lift system; arranging an elongated bore in said plunger from said lower end thereof; and arranging a plurality of fins on a lower end of the plunger. The fins may be arranged in a spiral with respect to said longitudinal axis of the bore. The method may include the step of spinning the plunger about its longitudinal axis so as to generate turbulence in gas surrounding the plunger as the plunger travels through the tubing string in an oil and gas well lift system.

The invention also includes a method of cleaning interior walls of a tubing string in a plunger lift system of an oil and gas well wherein an elongated plunger controllably travels vertically therethrough, comprising one or more of the steps of: arranging an array of fins on a lower end of the elongated plunger, wherein the fins have a sharp edge in close proximity to the walls of the tubing string; rotating the elongated plunger about a longitudinal axis thereof, as the plunger travels through the tubing string in the plunger lift system; and cleaning the walls of the tubing string by scraping of the sharp cleaning edges of the fins, as the rotating plunger travels vertically therethrough; and ejecting gas through an angled arrangement of side holes, either forward in one embodiment, rearward in another embodiment, or tangentially from the bore to the grooves in yet a further embodiment, in the plunger to maximize turbulence of fluid surrounding the plunger as it travels in the tubing string in the oil and gas well lift system.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
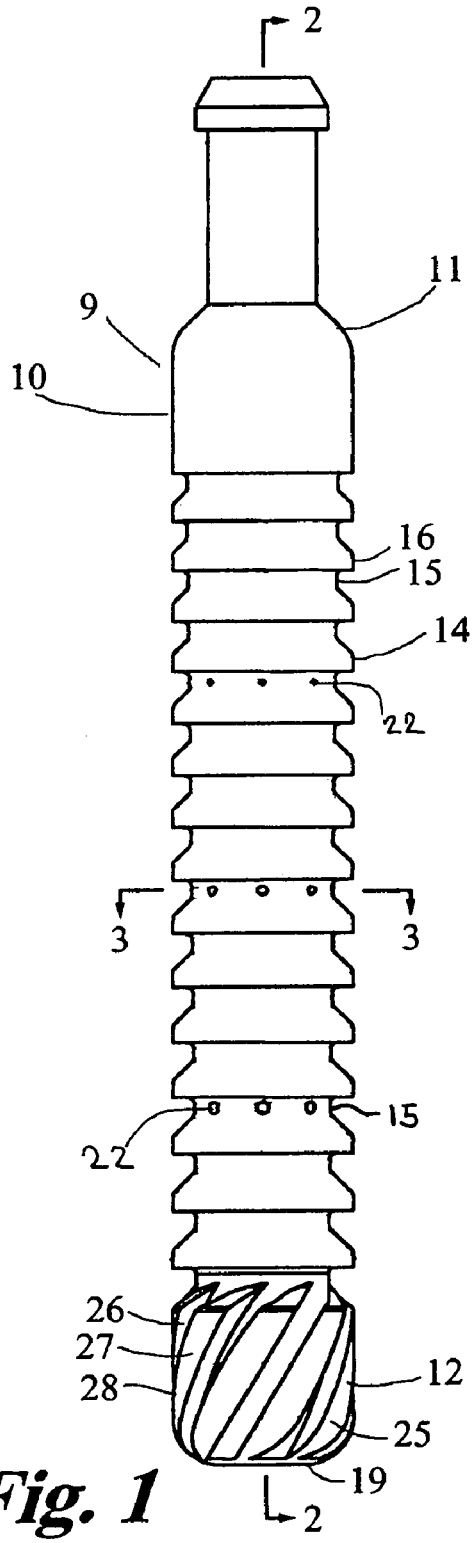
FIG. 1 is a side view of a plunger embodying features of the present invention.
Figure 3:
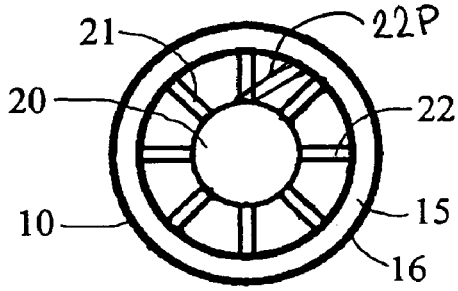
FIG. 3 is a cross sectional view of the plunger of FIG. 1 taken along line 3-3.
Figure 2:
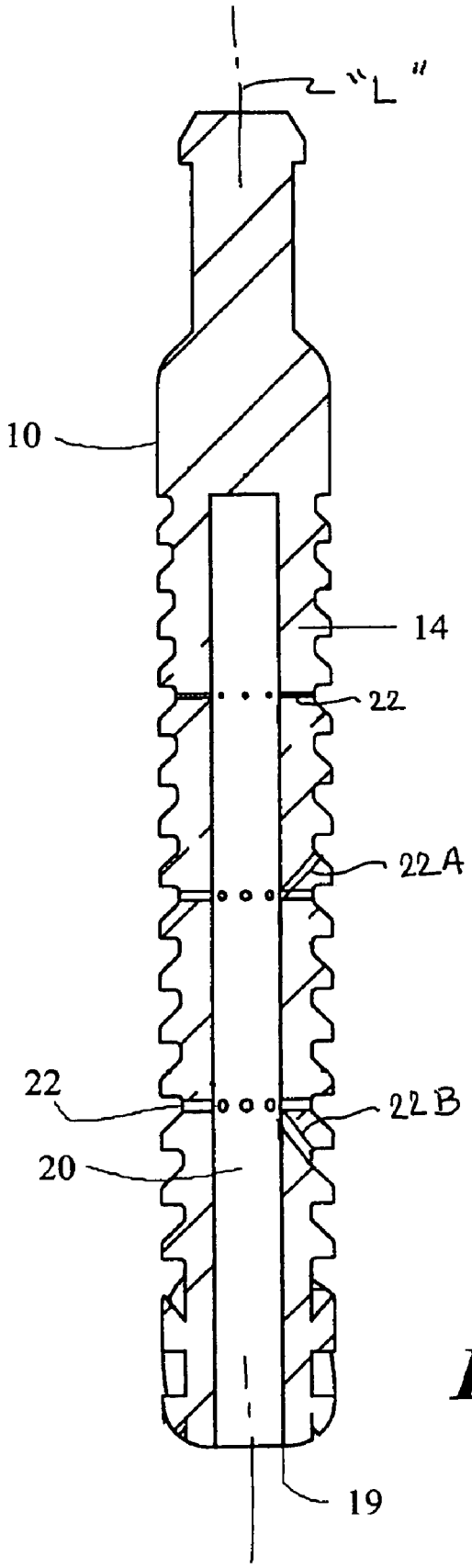
FIG. 2 is a cross sectional view of the plunger of FIG. 1 taken along line 2-2.

Referring now to the drawings in detail, and particularly to FIGS. 1, 2 and 3, an elongated gas lift plunger 9 having a longitudinal axis "L", the plunger 9 embodying features of the present invention which includes a cylindrical, elongated plunger body 10 with a fishing neck portion or top portion 11 at the top, a lower portion 12 at the bottom and an intermediate portion 14 between the top and bottom portions 11 and 12. The plunger body 10 is sized to fit into a selected size tubing string with a selected clearance to allow liquid to flow upward during the time the well valve is closed.

Describing the specific embodiments herein chosen for illustrating the invention, certain terminology is used which will be recognized as being employed for convenience and having no limiting significance. For example, the terms "up", "down", "top", and "bottom: refer to the illustrated embodiment in its normal position of use. The terms "outward" and "inward" will refer to radial directions with reference to the central axis of the device. Further, all of the terminology above-defined includes derivatives of the word specifically mentioned and words of similar import.

Figure 4:
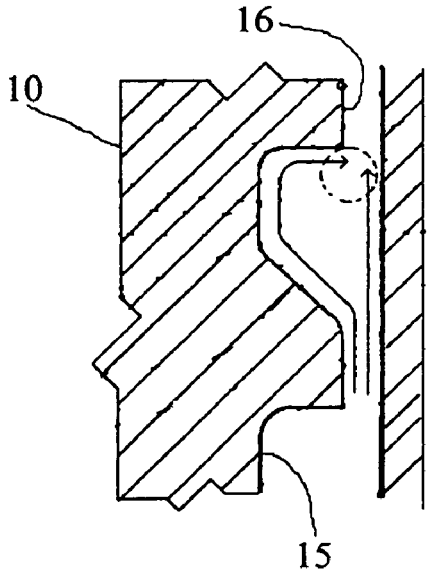
FIG. 4 is an enlarged partial view of FIG. 2 with a section of the tubing string added.

The fishing neck portion 11 has an exterior size and shape corresponding to a conventional oil and gas well plunger fishing neck. The intermediate portion 14 includes a plurality of longitudinally spaced, circumferential grooves 15 that divide the peripheral surface of the intermediate portion 14 into a plurality of outer surface sections 16. Preferably the grooves 15 are sized, shaped and spaced as set forth in U.S. Pat. No. 6,200,103 and as shown in FIG. 4.

As shown in FIG. 2, the plunger body 10 has an elongated, cylindrical interior cavity 20 that extends upwardly from the bottom 19 of the plunger body 10 through the intermediate portion 14. The interior cavity 20 is open at the bottom 19. Spaced sets 21 of passages 22 extend from the interior cavity 20 to the grooves 15. The sets 21 of passages 22 shown may preferably extend to the fourth, eighth and twelfth grooves 15 as counted upwardly. The sets 21 of passages 22 can extend to other grooves. Referring to FIG. 3, each set 21 shown includes eight circumferentially spaced, radially extending passages 22. Preferably the diameter of the passages 22 decreases from the lower to upper sets 21, as may be seen in FIGS. 1 and 2. In a further preferred embodiment, an array of passages or side holes 22A arranged forwardly, and side holes 22B disposed lower or rearwardly through the wall of the plunger 9, as represented in FIG. 2. The side holes 22A and 22*b* are shown arranged at an acute angle with respect to the longitudinal axis "L" of the plunger 9, to add to turbulence of fluid flow within the channels or grooves 15 around the plunger 9. A somewhat tangentially directed passageway 22P is shown in FIG. 3, extending from the bore 20 to a channel or groove 15, in FIG. 3. This tangential passageway 22P helps rotate the plunger 9 about its longitudinal axis "L" to give the plunger 9 a "pinwheel" effect and help with rotation and turbulence simultaneously.

The lower portion 12 includes a plurality of circumferentially spaced, radially extending, angled fins or flutes 25 separated by channels 26. The flutes 25 each have an outer surface 27 bounded laterally by sharp corners 28. The diameter of the lower portion 12, as measured at the outer surfaces 27 is preferably the same as the diameter of the outer surface sections 16 of the intermediate portion 14. Preferably the flutes 25 are angled at about 30 degrees.

The shape of the grooves 15 creates a turbulent flow region that inhibits liquid flow downward into the groove 15 and inhibits gas flow upward out of the groove 15. The interior cavity 20 reduces the weight of the plunger 9. Gas flow up through the interior cavity 20 and out through the passages 22 increases the turbulence in the grooves 15, increasing the turbulent gas to liquid sealing effect of the groove 15 design. Gas flow up through the channels 26 causes the plunger 9 to spin. As the plunger 9 spins, the corners 28 of the fins 25 clean the inside walls of the tubing string to minimize build-up of paraffin and scale therein. Spinning the plunger 9 also increases the turbulence in the grooves, increasing the turbulent gas to liquid sealing effect of the groove 15 design.

Some wells produce frac or formation sand fines which can pack in around a plunger 9 when it is in the lubricator during the after-flow cycle causing the plunger 9 to become stuck. Gas escaping through the passages 22 while the plunger 9 spins in the lubricator at the surface during the after-flow cycle of the plunger 9 precludes the plunger 9 from becoming sanded off. The action of the spinning plunger 9 and the jet effect of the interior cavity 20 and passages 22 also mitigate against the plunger 9 becoming stuck in the lubricator.

By way of example, and not as a limitation, for a 2 inch tubing string, the plunger 9 would be 15 inches long and the outer diameter of the plunger 9 would be about 1.875 inches to about 1.890 inches. There are sixteen grooves 15 and the diameter at the grooves 15 would increase from 1.385 inches for the lowest groove 15 to 1.571 inches for highest groove 15. The vertical length of the flutes 25 would be about 2 inches and the diameter at the inside of the channels 26 would be 1.375 inches. The diameter of the passages 22 would be 0.125 inches for the lowest set 21, 0.094 inches for the middle set 21 and 0.043 inches for the highest set 21.

Although the present invention has been described with a certain degree of particularity, it is understood that the present disclosure has been made by way of example and that changes in details of structure may be made without departing from the spirit thereof.

I claim:

1. A plunger for moving up and down in a tubing string in a plunger lift system for an oil and gas well, said plunger having a gas seal arrangement comprising:

an elongated plunger body having an upper end and a lower end, said plunger having a longitudinal axis, with a plurality of circumferentially grooves spaced longitudinally apart on an outer surface of said plunger body;

a longitudinal bore arranged within said plunger, extending from an opening in said lower end of said plunger; and an arrangement of fluid passageways extending from said bore to an outer surface of said plunger body, wherein at least one of said passageways extends at an acute angle with respect to said longitudinal axis of said plunger body from said bore, to permit gas flow therethrough to direct a turbulent flow of fluid about said plunger.

2. The plunger as recited in claim 1, wherein at least one of said passageways extends radially outwardly in said plunger body from said bore.

3. The plunger as recited in claim 1, wherein at least one of said passageways extends tangentially with respect to said bore in said plunger.

4. The plunger as recited in claim 1, wherein a plurality of fins are arranged on said lower end of said body of said plunger to effect a rotational motion in said plunger as said plunger travels through said tubing string.

5. The plunger as recited in claim 4, wherein, said fins are in a spiral array on said lower end of said plunger.

6. The plunger as recited in claim 4, wherein said fins have a tube wall cleaning sharp edge for cleaning the inside of the tubing string as said plunger travels rotationally therethrough.

7. A method of controlling fluid flow in a tubing string in a plunger lift system of an oil and gas well wherein an elongated plunger controllably travels vertically therethrough, comprising:

arranging an array of fins on a lower end of said elongated plunger, wherein said fins create turbulence in gas within said tubing string; and rotating said elongated plunger about a longitudinal axis thereof, as said plunger travels through said tubing string in said plunger lift system;

arranging an elongated bore in said plunger from said lower end thereof; and drilling a plurality of side holes into said bore through said plunger.

8. The method as recited in claim 7, wherein said side holes are arranged radially with respect to said longitudinal axis of said bore.

9. The method as recited in claim 7, wherein said side holes are arranged at an acute angle with respect to said longitudinal axis of said bore.

10. The method as recited in claim 7, including:

spinning said plunger about its longitudinal axis by ejecting gas tangentially with respect to said bore and into said grooves, so as to generate turbulence in gas surrounding said plunger as said plunger travels through said tubing string in an oil and gas well lift system.

11. The method as recited in claim 10, including:

ejecting gas through said side holes into said grooves in said plunger to maximize turbulence of fluid surrounding said plunger as it travels in said tubing string in said oil and gas well lift system.

12. A method of controlling fluid flow in a tubing string in a plunger lift system of an oil and gas well wherein an elongated plunger controllably travels vertically therethrough, comprising:

arranging an array of side holes through a side wall of said elongated plunger, wherein said side holes create turbulence in gas within said tubing string; and rotating said elongated plunger about a longitudinal axis thereof, as said plunger travels through said tubing string in said plunger lift system.

13. The method of controlling fluid flow in a tubing string, as recited in claim 12, including:

arranging an elongated bore in said plunger from said lower end thereof; and arranging a plurality of fins on a lower end of said plunger.

14. The method as recited in claim 13, wherein said fins are arranged in a spiral with respect to said longitudinal axis of said bore.

15. The method as recited in claim 13, including:

spinning said plunger about its longitudinal axis so as to generate turbulence in gas surrounding said plunger as said plunger travels through said tubing string in an oil and gas well lift system.

16. A method of cleaning interior walls of a tubing string in a plunger lift system of an oil and gas well wherein an elongated plunger controllably travels vertically therethrough, comprising:

arranging an array of fins on a lower end of said elongated plunger, wherein said fins have a sharp edge in close proximity to said walls of said tubing string;

rotating said elongated plunger about a longitudinal axis thereof, as said plunger travels through said tubing string in said plunger lift system;

cleaning said walls of said tubing string by said sharp edges of said fins, as said rotating plunger travels vertically therethrough; and ejecting gas through said an angled arrangement of at least one side hole from a central bore to the outside said plunger to maximize turbulence of fluid surrounding said plunger as it travels in said tubing string in said oil and gas well life system.

17. The method as recited in claim 16, wherein adjacent said side holes may be of different diameters from one another, to create a nozzle effect.

* * * * *